United States Patent [19]

Nilsson

[11] 4,220,249

[45] Sep. 2, 1980

[54] CLOSING ARRANGEMENT FOR PACKING CONTAINERS

[75] Inventor: Erling I. Nilsson, Akarp, Sweden

[73] Assignee: Tetra Pak Developpement SA, Lausanne, Switzerland

[21] Appl. No.: 917,202

[22] Filed: Jun. 20, 1978

[30] Foreign Application Priority Data

Jun. 20, 1977 [SE] Sweden ..... 7707099

[51] Int. Cl.[2] ..... B65D 43/16; B65D 43/18; B65D 45/00

[52] U.S. Cl. ..... 215/237; 215/253; 215/306; 220/269; 220/307; 220/375

[58] Field of Search ..... 215/237, 245, 250, 256, 215/253, 306; 220/269, 270, 306, 307, 375, 339

[56] References Cited

U.S. PATENT DOCUMENTS

| | | | |
|---|---|---|---|
| 2,886,198 | 5/1959 | Herter | 215/321 |
| 3,317,070 | 5/1967 | Rausing | 215/254 |
| 3,986,627 | 10/1976 | Zapp | 215/237 |
| 3,999,678 | 12/1976 | Ignell | 220/269 |

FOREIGN PATENT DOCUMENTS

| | | | |
|---|---|---|---|
| 225449 | 3/1969 | Sweden | 215/1 C |

*Primary Examiner*—George T. Hall

*Attorney, Agent, or Firm*—Burns, Doane, Swecker & Mathis

[57] ABSTRACT

A closing arrangement for a packing container is disclosed including a tubular member that may be firmly anchored within a pouring opening of the container. A cap member closes the tubular member and is provided with a pull-ring. The cap member is joined to the tubular member by a first connecting member which may be broken to open the container. The cap member is also joined to the tubular member by a second connecting member which forms a hinge located diametrically opposite to the pull ring. The second connecting member retains the cap member on the tubular member after the container is opened. The pull ring includes a locking element which cooperates with the tubular member to provide a catch. Upon movement of the pull-ring to open the container, the catch is caused to disengage from the tubular member. In this way, the first connecting element is broken but the catch permits a reclosure of the container. The closing arrangement is preferably made of a plastic material especially polyolefin.

9 Claims, 3 Drawing Figures

CLOSING ARRANGEMENT FOR PACKING CONTAINERS

BACKGROUND AND SUMMARY OF THE PRESENT INVENTION

The present invention relates to a closing arrangement for packing containers which arrangement comprises a tubular part that can be firmly anchored in the pouring opening of the packing container and a cap part closing this tubular part provided with a pull-ring and which is joined to the tubular part by means of a first connecting element, which is adapted so that it is broken when the packing container is opened, and a second connecting element in the form of a hinge element located diametrically opposite the pull-ring which is adapted so that it retains the cap part on the tubular part after the opening of the package.

Closing arrangements of this type are manufactured from flexible plastic material, e.g. polyethylene, and are used for the closing of one-way bottles. After the filling of the bottle with the desired contents the tubular part of the closing arrangement is pressed down into the pouring opening of the package where it is retained against the effect of any internal pressure in the package caused by the contents by means of a retaining flange co-operating with the bottleneck. To ensure a good seal between the tubular part and the neck of the packing container the tubular part is provided with a number of sealing rings which are pressed against the inside of the neck. The upper end of the tubular part is joined to the cap part located above the upper end of the pouring opening by means of a weakened annular region, a so-called tear-ring . When the package is to be opened the consumer introduces a finger into the pull-ring and lifts the same upwards, so that a part of the cap part delimited by means of a weakening line serving as a hinge joint is lifted upwards and the tear-ring is caused to break along a part of its periphery. On continued pulling upwards of the pull-ring the tear-ring breaks completely, whereupon the cap part can be pivoted away from the tubular part about the hinge element located diametrically opposite the pull-ring. The packing container is now open and the contents can be poured out through the tubular part of the closing arrangement.

In packing containers of such a size that the whole contents cannot be consumed directly after the opening, but where a part is saved for consumption on a later occasion, it is often desirable for the packing container to be reclosable so as to prevent the contents from being contaminated or from being emptied out should for example the package be overturned.

It is an object of the present invention therefore to provide a closing arrangement of the abovementioned type in such a manner that the cap part after opening of the package can be used to reclose the packing container and to prevent the unintentional emptying out of the contents of the packing container.

It is a further object of the present invention in spite of a cheap and simple design to make possible the repeated reclosing and opening without the function of the closing arrangement being endangered, for example, because of wear.

These and other objects have been achieved in accordance with the invention in that a closing arrangement of the type described in the introduction has been given the characteristic that the pull-ring comprises a locking element co-operating with the tubular part in the form of a catch which is placed so that the maneuvering of the pull-ring on opening the packing container first causes the catch to disengage from the tubular part and subsequently gives rise to the first connecting element being broken. The provision of the catch allows retention of the cap part in the reclosed position. By reason of the placement of the catch moreover unnecessary stresses on the catch and wear of the same are prevented thus ensuring perfect function.

In a preferred embodiment of the closing arrangement described the pull-ring extends at an angle downwards along the tubular part which at its upper end has a flange extending parallel with the cap part. This embodiment has been given the characteristic that the catch is arranged so that on the side of the pull-ring facing the flange the catch extends below the said flange when the closing arrangement is not acted upon.

As a result the catch will automatically be shifted from its engagement with the tubular part when a finger is introduced into the pull-ring for the purpose of opening the closing arrangement.

A further preferred embodiment of the closing arrangement in accordance with the invention has been given the further characteristic that the closing arrangement is manufactured from a flexible plastic material, in particular a polyolefin.

BRIEF DESCRIPTION OF THE DRAWINGS

The invention will now be described in detail with reference to the enclosed drawing which shows diagrammatically a preferred embodiment of the closing arrangement in accordance with the invention.

DETAILED DESCRIPTION OF A PREFERRED EMBODIMENT

Figure 1:
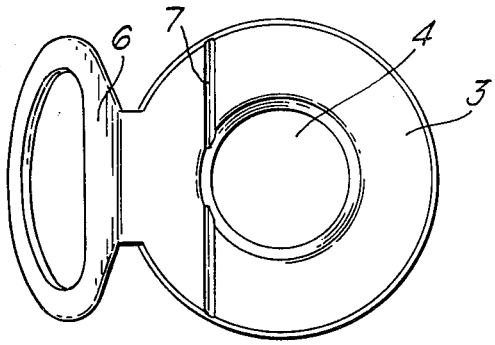
FIG. 1 shows a top view of a closing arrangement in accordance with the invention before opening.

The embodiment of the closing arrangement in accordance with the invention shown on the drawing comprises a tubular lower part 1 and a cap part 2 joined to it. The cap part 2 has a substantially circular flange 3 and a recessed area 4 situated centrally which extends down into the central hole 5 of the tubular part 1. The flange 3 of the cap part 2 is joined at one part of its periphery to a pull-ring 6 which extends at an angle downwards from the flange 3. The cap part 2 is provided furthermore with a groove 7 arranged in its upper surface which is a tangent on the recessed region 4 and is intended to facilitate the tearing off of the cap part 2 when the package is to be opened. This will be described in more detail in the following. The cap part 2 is joined via a weakened region or tear-ring 8 to the upper surface of the tubular part 1. This upper surface constitutes the upper surface of a flange 9 situated at the upper end of the tubular part 1 which is parallel with the flange 3 and located at a certain distance underneath the same. Underneath the flange 9 the outer surface of the annular part 1 is provided with a number of sealing rings 10 and a retaining ring 11. The bottom end of the tubular part terminates in a conical part 12 which facilitates the introduction of the tubular part into the neck opening of the packing container. After being placed into the neck opening of a packing container 13 the tubular part assumes the position shown in FIG. 2. The neck opening of the packing container 13 is provided with an annular "lip" 14 turned inwards, the terminal edge of which makes contact with the retaining flange 11 and locks the tubular part in the neck opening. By virtue of the contact existing between the sealing rings 10 and the lip 14 a good seal is assured between the container 13 and the tubular part 1. When the tubular part has been pressed down into the correct position in the packing container, the flange 9 moreover will be in contact with the upper edge of the packing container. The flange 3 of the cap part 2 and the flange 9 of the tubular part 1 are connected to one another in a peripheral region by means of a connecting element on hinge 15 which is located diametrically opposite the pull-ring and serves for retaining the cap part after the opening on the tubular part and thus on the packing container.

Figure 2:
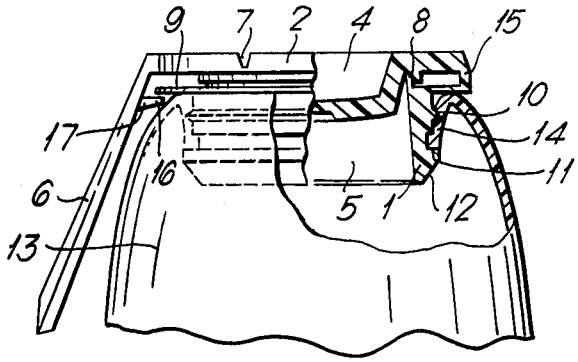
FIG. 2 shows a side view, partially in section, of the closing arrangement in accordance with FIG. 1 before opening and fitted into a bottleneck.

FIG. 2 indicates how the pull-ring 6 is provided on its underside with a catch or lip 16 which with its outer end projects obliquely upwards close to the underside of the flange 9. The long and narrow shape of the catch 16 and its arrangement obliquely upwards ensure that the catch will be capable of retaining a reclosed cap part in shut position at the same time as the catch can readily pass the flange when the cap part is lowered to its reclosing position, since the underside of the catch is provided with an oblique sliding surface 17. As a result the catch as well as the pull-ring 6, both of which are manufactured from a flexible material, will on reclosure of the container be pressed outwards from the centre of the closing arrangement when the catch passes the flange 9, and will then owing to the flexibility of the material spring inwards again to the position shown in FIG. 2 when the flange 9 has been passed.

Figure 3:
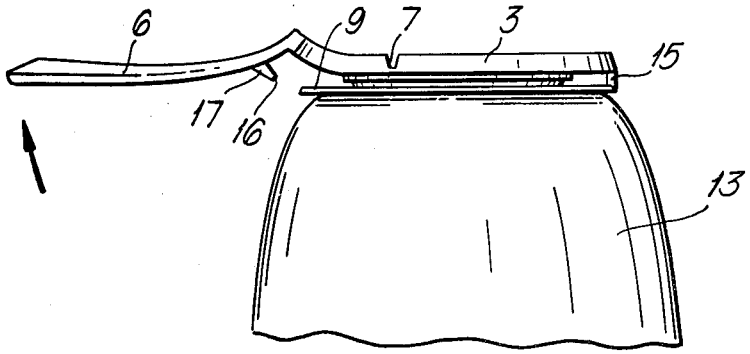
FIG. 3 shows the closing arrangement in accordance with FIG. 2 during opening.

When the closing arrangement is to be broken so as to allow the emptying out of the contents of the packing container, this is done by introducing a finger into the loop of the pull-ring 6 and lifting the pull-ring obliquely upwards in the direction indicated by means of the arrow shown in FIG. 3. In a first phase the pull-ring 6 and the portion of the closing arrangement situated between the pull-ring and the groove 7 will be bent upwards to the position shown in FIG. 3. During this movement the lip or catch 16 will first be pivoted outwards in the direction away from the centre line of the closing arrangement and then obliquely upwards to the position shown. This makes it possible for the catch 16 to pass the flange 9 without making contact or sliding against it, thus preventing deformation or wear of the catch and facilitating opening of the closing arrangement. On continued pulling in the direction of the arrow the groove 7 will serve as a hinge and the portion of the flange 3 of the cap part which is situated between the groove 7 and the pull-ring 6 will be further lifted upwards until the area of the tear-ring located underneath the groove 7 breaks. On continued pulling upwards the tear-ring 8 will break completely, whereupon the cap part 2 can be fully pivoted upwards about the hinge element 15 so that the contents of the packing container 13 can be emptied out through the central pouring opening 5 of the tubular part 1.

When the packing container has not been completely emptied and it is desired to reclose the same, the cap part 2 of the closing arrangement is pivoted back about the hinge element 15, the bottom sliding surface 17 of the catch 16 being brought into contact with the top edge of the flange 9. By continuing to press the cap part 2 downwards the catch, owing to the shape of the sliding surface 17 and the flexibility of the material, will be shifted outwards in the direction away from the centre of the closing arrangement, until the end of the catch can pass the outer boundary edge of the flange 9. The catch 16 then snaps back again under the bottom surface of the flange 9, so that the cap part as well as catch and pull-ring assume the position shown in FIG. 2, with the exception of the tear-ring 8 which of course remains broken. Thanks to a precise fit between the recessed portion 4 of the cap part and the pouring opening 5 of the tubular part, however, a satisfactory seal can be obtained on reclosure.

By placing the catch 16 at the upper end of the pull-ring 6, the catch 16, on opening of the closing arrangement in accordance with the invention, will be pivoted away so as to disengage from the flange 9. This is made possible not least by the pull-ring and the portion of the cap part situated between the pull-ring and the groove 7 being pivoted at the start about the groove 7 which thus serves as a hinge element. Through this the catch 16 is subjected to a movement directed outwards from the centre of the closing arrangement which prevents the catch from hindering the opening of the closing arrangement or being subjected to unnecessary stresses and wear. Naturally it is also a condition for the functioning of the catch that the closing arrangement should be manufactured from a material of appropriate flexibility. The preferred material is a flexible plastic material, and in practical tests a plastic material of the polyolefin type has proved to give good results and to meet the requirements on flexibility that are made. Moreover, the material can readily be moulded with sufficient precision to produce the desired shape.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the present invention.

I claim:

1. A packing container having a closure, comprising:

a container having a first opening;

an annular member securely received within the first opening to define a second opening, said annular member having a flange attached to an upper surface of the annular member, said flange extending outwardly from the container;

cap means for closing the second opening;

pull means for permitting the cap means to be manually moved relative to the second opening;

first connecting means for sealingly joining the cap to the annular member at the second opening, said first connecting means being broken when the cap means is moved manually relative to the second opening;

hinge means for attaching the cap means to the annular member; and catch means for engaging the annular flange to releasably fix the cap means with respect to the container whereby the packing container may be reclosed after opening.

2. The packing container of claim 1 wherein the catch means including a catch which is disengaged from the flange before the first connecting means is broken upon opening of the container.

3. The packing container of claim 2 wherein the pull means includes a pull-ring which extends downwardly along the container with the catch provided on a side of the pull-ring facing the flange of the annular member, said catch being arranged on a portion of the pull-ring nearest the cap.

4. The packing container of claim 1 wherein the closure is of a flexible plastic material.

5. The packing container of claim 4 wherein the flexible plastic material is polyolefin.

6. The packing container of claim 3 wherein the hinge means includes a hinge member located diametrically opposite the pull-ring.

7. The packing container of claim 2 wherein the flange is parallel with the cap means when the second opening is closed by the cap means.

8. The packing container of claim 1 wherein the catch means comprises a catch having an outer end projecting obliquely upward to an underside of the flange.

9. The packing container of claim 8 wherein the catch has an oblique sliding surface provided on an underside of the catch.

* * * * *